US006949875B2

(12) United States Patent
Hwang et al.

(10) Patent No.: US 6,949,875 B2
(45) Date of Patent: Sep. 27, 2005

(54) DEFLECTION YOKE FOR CATHODE RAY TUBE

(75) Inventors: Sung-Gu Hwang, Suwon (KR); Yasunobu Kuwahara, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/616,639

(22) Filed: Jul. 9, 2003

(65) Prior Publication Data

US 2004/0032228 A1 Feb. 19, 2004

(30) Foreign Application Priority Data

Aug. 9, 2002 (KR) ..... 10-2002-0047046

(51) Int. Cl.[7] ..... H01J 29/70
(52) U.S. Cl. ..... 313/440; 335/210
(58) Field of Search ..... 315/399; 313/440, 313/421; 335/210–213

(56) References Cited

U.S. PATENT DOCUMENTS 4,553,120 A * 11/1985 Dam ..... 335/210
5,942,845 A * 8/1999 Matsubara ..... 313/440
6,046,538 A * 4/2000 Hishiki et al. ..... 313/440
6,380,698 B1 * 4/2002 Dasgupta ..... 315/368.25
6,452,321 B1 * 9/2002 Kojima ..... 313/440
6,509,681 B1 * 1/2003 Park et al. ..... 313/440
6,633,116 B1 * 10/2003 Lee ..... 313/440
6,696,907 B1 * 2/2004 Iwaya et al. ..... 335/210
6,703,801 B2 * 3/2004 Yoshinaga et al. ..... 315/399
2002/0084739 A1 * 7/2002 Kim et al. ..... 313/440
2002/0140337 A1 * 10/2002 Kim et al. ..... 313/346 R
2003/0025468 A1 * 2/2003 Taniwa et al. ..... 315/399

* cited by examiner

*Primary Examiner*—Thuy Vinh Tran
(74) *Attorney, Agent, or Firm*—Christie, Parker & Hale, LLP

(57) ABSTRACT

A deflection yoke for a cathode ray tube includes a ferrite core that has a body that is funnel-shaped and with an inner surface and an outer surface, the inner surface of the ferrite core including a first section formed as a circle with a predetermined, unvarying radius; a second section formed as a circle with a varying radius, the second section being connected to the first section; and a third section having a non-circular cross section and connected to the second section.

13 Claims, 5 Drawing Sheets

DEFLECTION YOKE FOR CATHODE RAY TUBE

CROSS-REFERENCE TO RELATED APPLICATIONS

This application claims priority to and the benefit of Korean Application No. 2002-0047046, filed on Aug. 9, 2002 in the Korean Intellectual Property Office, the entire content of which is incorporated herein by reference.

BACKGROUND OF THE INVENTION (a) Field of the Invention

The present invention relates to a deflection yoke for a cathode ray tube, and more particularly, to a ferrite core of a deflection yoke used in a cathode ray tube.

(b) Description of the Related Art

A typical cathode ray tube is structured with an electron gun mounted within a neck, a shadow mask and a phosphor screen mounted to a panel, and a deflection yoke mounted to an outer circumference of a funnel. Electron beams emitted from the electron gun are deflected by a magnetic field generated by the deflection yoke, and the deflected electron beams pass through the shadow mask to land on the phosphor screen and illuminate the screen. Predetermined images are realized through this process.

The deflection yoke includes a horizontal deflection coil and a vertical deflection coil. The two coils are mounted to the outer circumference of the funnel in a state adjacent to one another. Further, a core (typically made of ferrite) is provided covering the vertical deflection coil. A horizontal deflection current flows through the horizontal deflection coil to generate a horizontal deflection magnetic field, and a vertical deflection current flows through the vertical deflection coil to generate a vertical deflection magnetic field.

The electron beams emitted from the electron gun progress toward the phosphor screen by an anode voltage (i.e., by attraction to the positive voltage) to enter a region where there is a deflection magnetic field generated by the deflection yoke. While in the deflection magnetic field, the electron beams receive a force according to Fleming's left hand rule to be deflected by a deflection current. The electron beams then scan the phosphor screen to realize predetermined images.

The power consumed to deflect the electron beams is indicated by a flux density B generated by the vertical deflection coil and the horizontal deflection coil. Flux density B is given by Equation 1 as follows.

$$B=4\pi*10^{-7}(ni/Dy) \quad \text{[Equation 1]}$$

where n is the number of windings of the deflection coils, i is the deflection current (in units of amperes), and Dy is an inner diameter of the ferrite core (given in units of centimeters).

Therefore, the power consumed by the deflection yoke depends, to a great extent, on the size of the inner diameter of the ferrite core. That is, power consumption may be best reduced by reducing the inner diameter of the ferrite core. Accordingly, energy-saving cathode ray tubes are now being developed, in which the shape of the funnel of the CRT is changed from having a cylindrical cross section to approximately a rectangular cross section and the inner diameter size of the deflection yoke is reduced.

If cross sections of the area where the deflection yoke is mounted are compared between the above energy-saving CRT and a traditional CRT, the traditional CRT forms a circle in this area while the energy-saving CRT has a cross section that is approximately rectangular, that is, a cross section with circular arcs connected at four corners that are substantially at right angles. With this configuration, the energy-saving CRT has an inner diameter that is reduced by 30% in the horizontal axis direction when compared to the traditional CRT.

Accordingly, the horizontal coil, vertical coil, and ferrite core of the deflection yoke are also reduced in size. Since the horizontal coil and vertical coil are structured by bending copper wire that is coated with flexible enamel resin in a saddle shape, these elements may be formed through a shrinking process. However, the ferrite core is formed by pressing iron oxide containing iron, zinc, manganese, copper, nickel, barium, yttrium, etc. in a mold, then sintering the resulting material in a furnace at a temperature of approximately 1,400° C. If the sintered material is used as is, an error results in the precision of its dimensions of roughly ±0.5 mm. Therefore, grinding of the material is performed to more precisely form the ferrite core.

The ferrite core produced in this manner includes a portion formed as a circle, and portions that are substantially rectangular and formed of three circles of differing radii. About 75% of this configuration is approximately rectangular.

In an effort to increase productivity, grinding of the ferrite core is performed by contacting a rotating grindstone to an inner surface of the core and performing grinding to a depth of approximately 0.5 mm, with grinding being discontinued when within ±0.1 mm of the desired depth to thereby ensure precision in the final dimensions. That is, the plate core is fixed to a grinding jig, and the grinding jig is rotated at a low speed (roughly 300 rpm), and the grindstone is rotated in a direction opposite to the rotating direction of the grinding jig at a relatively high speed (roughly 900 rpm) to thereby perform grinding of the ferrite core.

With the above grinding method, grinding may be performed on areas formed as a circle, but is not possible on the approximately rectangular areas, which comprise 75% of the core as described above. As a result, only the remaining 25% of the core undergoes grinding while the majority does not, thereby resulting in problems with respect to the precision in the dimensions of the core. This affects the operation of the deflection yoke such that the overall accuracy of the CRT is negatively affected.

SUMMARY OF THE INVENTION

In one embodiment, the present invention provides a deflection yoke for a cathode ray tube that allows for the grinding of an inner surface of a ferrite core mounted to a deflection coil. The deflection yoke increases an inner surface grinding area, and improves the overall precision in dimensions of the deflection yoke to realize a cathode ray tube with minimal dispersion.

In one embodiment, the present invention provides a deflection yoke for a cathode ray tube including a ferrite core that has a body that is funnel-shaped and includes an inner surface and an outer surface. The a cross section of inner surface of the ferrite core includes a first section having, along a length thereon, the shape of a circle with a predetermined, unvarying radius; a second section having, along a length thereon, the shape of a circle with a varying radius, the second section being connected to the first section; and a third section having a non-circular shape and being connected to the second section.

The third section of the inner surface has the shape of interconnected segments of three circles, each of a different radius. In another embodiment, the third section of the inner surface has the shape of a segment of a circle and two substantially straight lines. In yet another embodiment, the third section of the inner surface has the shape of interconnected segments of three circles and two substantially straight lines. The first and second sections have rougher surfaces than the surface of the third section.

In one embodiment, the present invention provides a deflection yoke for a cathode ray tube including a ferrite core that has a body that is funnel-shaped and includes an inner surface and an outer surface, in which the inner surface of the ferrite core includes a first section having, along a length thereon, the shape of a circle with a varying radius; and a second section having a non-circular shape and being connected to the first section.

In one embodiment, the second section of the inner surface has the shape of interconnected segments of three circles, each of a different radii. In another embodiment, the second section of the inner surface has the shape of a segment of a circle and two substantially straight lines,. In yet another embodiment, the second section of the inner surface has the shape of interconnected segments of three circles and two substantially straight lines. The first section has larger roughness than the second section.

DETAILED DESCRIPTION

Figure 1:
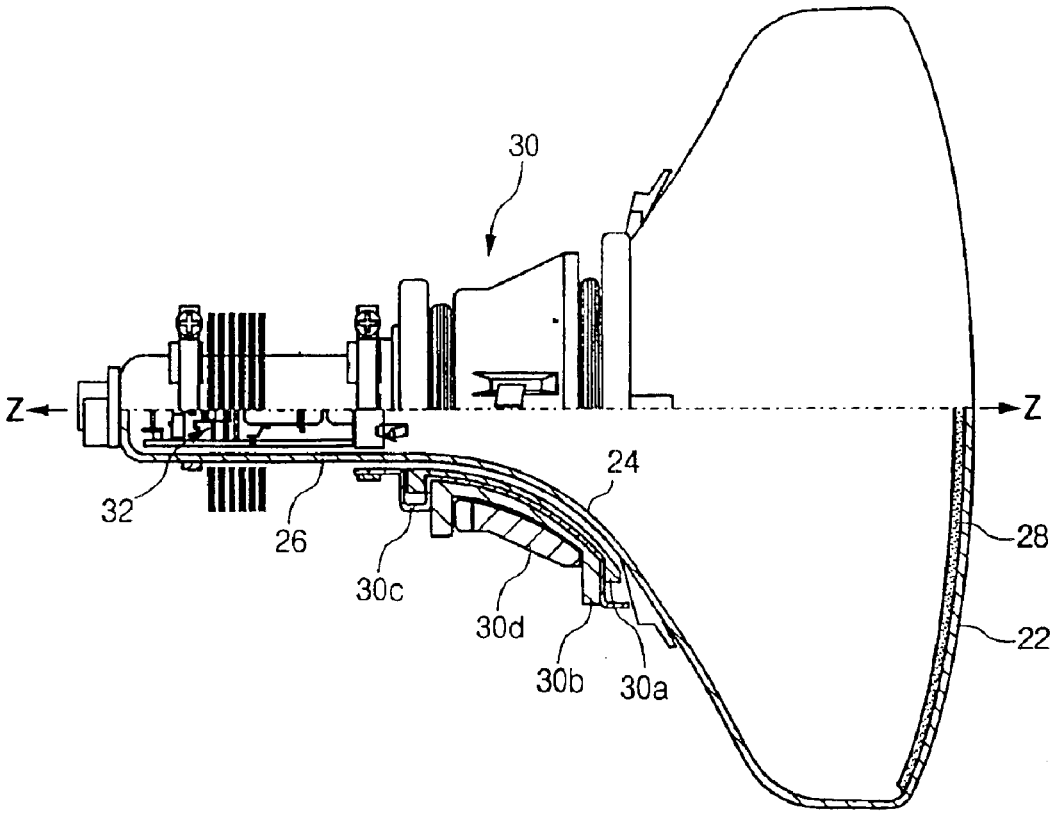
FIG. 1 is a side view of a cathode ray tube according to the present invention, in which half of the cathode ray tube is cut away to show a cross section thereof.

FIG. 1 is a side view of a cathode ray tube according to the present invention, in which half of the cathode ray tube is cut away to show a cross section thereof. The cathode ray tube (CRT) includes a panel 22 that is substantially rectangular, a funnel 24 connected to the panel 22 and having a cone shape, and a neck 26 connected to the funnel 24 and formed in the shape of a cylindrical tube. The panel 22, the funnel 24, and the neck 26 are assembled into an integral tube structure, the inside of which is maintained in a vacuum state.

A phosphor screen 28 is formed on an inner surface of the panel 22. The phosphor screen 28 is realized through R, G, and B phosphors arranged in a predetermined pattern. A deflection yoke 30 is mounted to an outer circumference of the funnel 24 to deflect electron beams that are used to scan the phosphor screen 28. An electron gun 32 is mounted within the neck 26 to produce the electron beams. The electron gun 32 is structured including three cathodes (R, G, and B cathodes) arranged in an in-line configuration and emitting three streams of electron beams.

The electron beams emitted from the electron gun 32 scan a center and peripheries of the phosphor screen 28 to land on desired phosphors and illuminate the same, thereby realizing the display of predetermined images. When the electron beams scan the peripheries of the phosphor screen 28, they are deflected by magnetic fields generated by the deflection yoke 30. That is, during operation of the CRT, the deflection yoke 30 generates horizontal and vertical magnetic fields, and the electron beams are deflected toward the peripheries of the phosphor screen 28 by the effect of the magnetic fields when they pass through the inside of the funnel 24. The deflection yoke 30 will be described in more detail below.

The deflection yoke 30 includes a horizontal deflection coil 30*a*, a vertical deflection coil 30*b*, and an insulating member 30*c* interposed between the horizontal and the vertical deflection coils 30*a* and 30*b* to electrically insulate them from each other. That is, the horizontal deflection coil 30*a* is positioned to an inner surface of the insulating member 30*c*, and the vertical deflection coil 30*b* is positioned to an outer surface of the insulating member 30*c*. The horizontal and the vertical deflection coils 30*a* and 30*b* have a shape corresponding to the shape of the insulating member 30*c*, and hence, to the shape of the funnel 24. The horizontal and vertical deflection coils 30*a* and 30*b* are realized through a pair of coil members and resemble the shape of the bell of a trumpet.

Further, a ferrite core 30*d* is mounted to a side of the vertical deflection coil 30*b* which is the side opposite to the side contacting the insulating member 30*c* (i.e., to the outside of the vertical deflection coil 30*b*). In this embodiment, the ferrite core 30*d* and the vertical deflection coil 30*b* are provided such that the deflection yoke 30 results in a saddle-saddle type of device.

The ferrite core 30*d*, which is a part of the deflection yoke 30 as described above, will now be described in more detail.

FIGS. 2–5 show the ferrite core 30*d* according to the first embodiment of the present invention.

Figure 2:
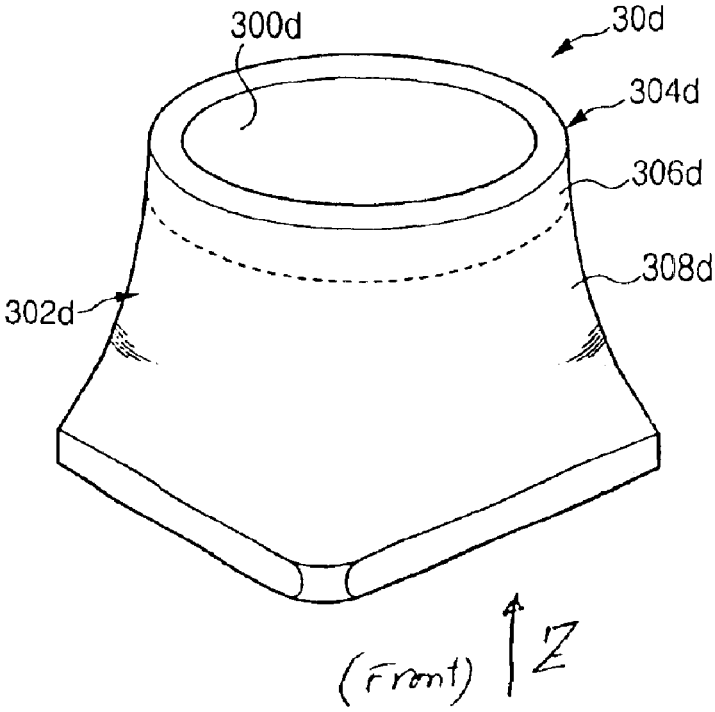
FIG. 2 is a perspective view of a ferrite core of a deflection yoke according to a first embodiment of the present invention.
Figure 3:
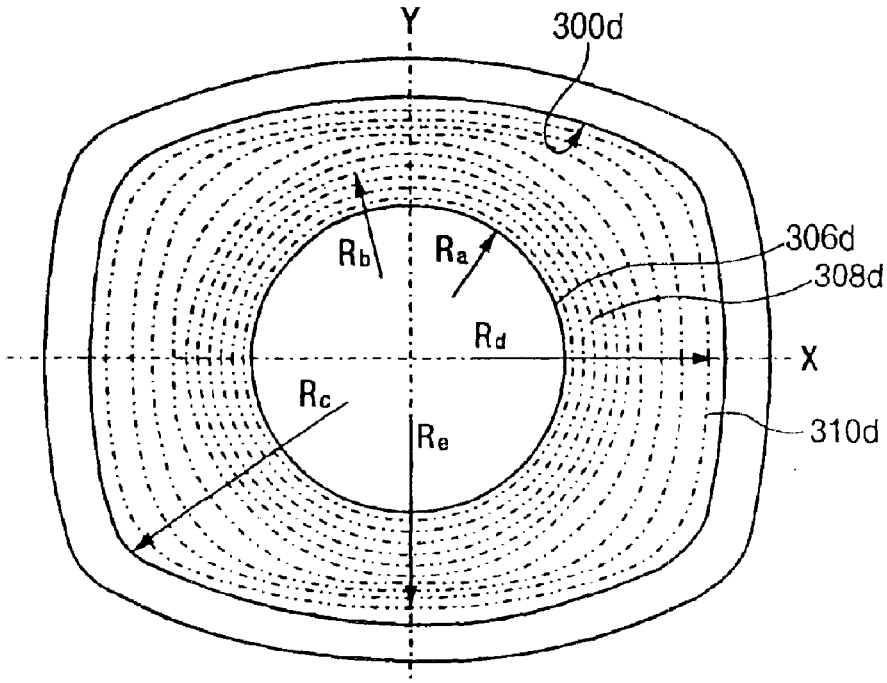
FIG. 3 is a front view of the ferrite core of FIG. 2.
Figure 4:
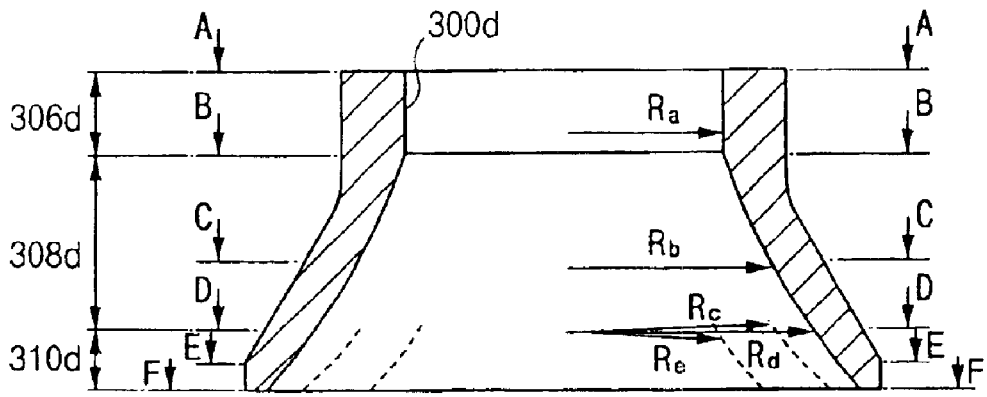
FIG. 4 is a side sectional view of the ferrite core of FIG. 2.
Figure 5:
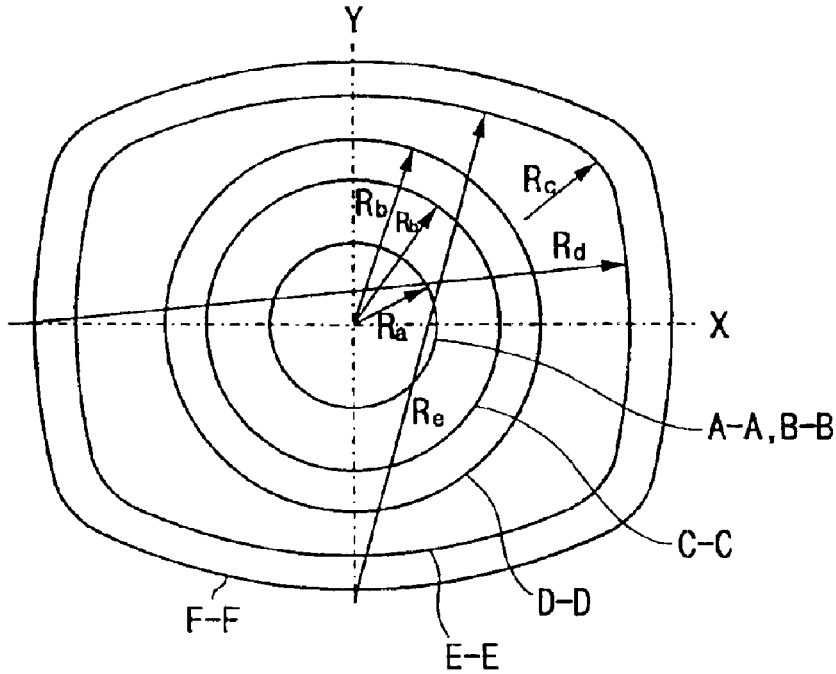
FIG. 5 is a sectional view that shows an inner surface of the ferrite core of FIG. 4 cut along lines A—A, B—B, C—C, D—D, E—E, and F—F, in which different areas of the ferrite core are shown on the same plane.

Referring to FIG. 2, the ferrite core 30*d* of the deflection yoke 30 includes a body 304*d* having an inner surface 300*d* and an outer surface 302*d*. The inner surface 300*d* has three sections. The first section 306*d* has the shape of a section of a circle with a radius Ra that does not vary from one end to the other end of the first section. The second section 308*d* is connected to the first section 306*d* and has the shape of a circle with a radius Rb that varies from one end to the other end of the second section. The radius Rb increases going from the back to the front of the ferrite core 30*d*, along the inner surface 310*d*) The third section 310*d* is connected to the second section 308*d* and has a non-circular cross section inner surface, as shown in FIG. 3.

The third section 310*d* of the inner surface 300*d* has the shape of segments of three circles, each segment with different radii Rc, Rd, and Re. A cross-sectional shape of the third section 310*d* is substantially rectangular. The third section 310*d* of the ferrite core 30*d* is indicated by the dotted lines in FIG. 4. Further, changes in the radius Rb of the second section 308*d*, and in the radii Rc, Rd, and Re of the third section 310*d*, moving from one end to the other end of each section are shown by the dotted lines in FIG. 3.

In sum, the inner surface 300*d* of the ferrite core 30*d* is structured such that the third section 310*d*, which is substantially rectangular in cross section, and the first section 306, which has a circular cross section with a radius Ra that does not vary, are connected through the second section 308*d*, which is located between the first section and the third section and has a circular cross section with a varying radius Rb. The structures of the first, second, and third sections 306*d*, 308*d*, and 310*d* are described below in more detail.

The first section 306*d* is formed as a cylindrical member that forms a circle in cross section. That is, the first section 306*d* has the same radius Ra over a predetermined length along an axis Z direction of the CRT shown in FIG. 1.

The second section 308*d* is formed as a cylindrical member that forms a circle in cross section and has the same radius as the first section 306*d* (Ra) where it is connected to the first section 306*d*. The second section 308*d* then has the radius Rb that increases along Z axis as the location where the second section 308*d* is connected to the third section 310*d* is approached (i.e., front of the ferrite core 30*d*). In the case where the increase in the radius Rb of the second section 308*d* is such that a line drawn along an outside of the second section 308*d* in the axis Z direction of the CRT is substantially straight (i.e., a uniform increase in the radius Rb), the basic shape of the third section 310*d* is that of a cone with its apex portion cut away. On the other hand, if the increase in the radius Rb of the second section 308*d* is such that a line drawn along the inside of the second section 308*d* in the axis Z direction of the CRT forms an exponential curve (of a second order equation or higher), the basic shape of the third section 310*d* is that of the bell of a trumpet.

The third section 310*d* has the shape of a circle having the radius Rb, where it is connected to the second section 308*d*. Starting from this point of connection to the second section 308*d*, the third section 310*d* increasingly becomes wider along a first direction (horizontal direction) and increasingly becomes shorter along a second direction (vertical direction), which is perpendicular to the first direction, thereby resulting in a substantially, but not exactly, rectangular shape with curved sides at its free end. As described above, the third section 310*d* is formed by combining three circular shaped parts, each with the different radii Rc, Rd, and Re. The three radii Rc, Rd, and Re increase in size in equal proportion to one another.

Centers of the radius Rd of the circle forming vertical edges lie on a horizontal axis X, centers of the radius Re of the circle forming horizontal edges lie on a vertical axis Y, and centers of the radius Rc of the circle forming corners where the horizontal edges meet the vertical edges lie on planes formed by the X and Y axes.

With the third section 310*d* as described above, the radius Rd of the circle forming the vertical edge and the radius Re of the circle forming the horizontal edge become infinitely closer to the vertical and horizontal edges forming nearly straight lines.

With respect to the manufacturing of the ferrite core 30*d* structured as described above, following sintering of the ferrite core, grinding of the inner surface 300*d* of the ferrite core 30*d* is performed. Grinding is performed similarly to the method used in the prior art. That is, the ferrite core 30*d* is rotated using a jig, and a grindstone is also rotated and moved along the inner surface 300*d* of the ferrite core 30*d*. In the first embodiment of the present invention, since grinding with respect to the first section 306*d* and the second section 308*d*, which are formed as cylindrical members with circular cross sections, is possible, grinding may be performed over a significantly larger area of the inner surface 300*d* of the ferrite core 30*d* than when compared to the conventional core. As a result, greater precision in the dimensions of the inner surface 300*d* of the ferrite core 30*d* may be obtained.

As described above, the third section 310*d* undergoes only a sintering process, while the first and second sections 306*d* and 308*d* undergo grinding following the sintering process. As a result, a striped pattern is formed on the surfaces of the first and second sections 306*d* and 308*d*, and the third section 310 ends up having a larger roughness.

Figure 6:
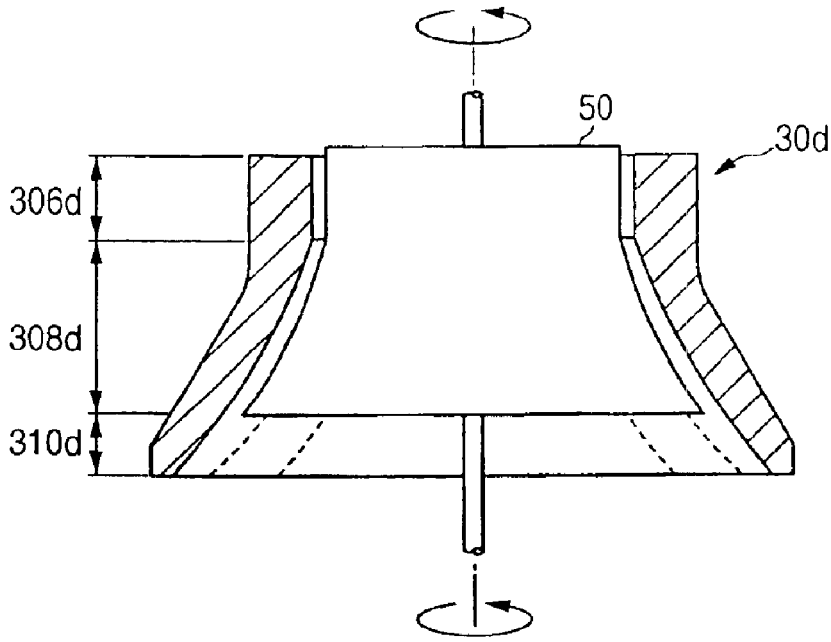
FIG. 6 is a sectional view used to describe a grinding process with respect to an inner surface of the ferrite core of FIG. 2.

With reference to FIG. 6, grinding of the first and second sections 306*d* and 308*d* is performed using a grindstone 50, which has the same general shape as the first and second sections 306*d* and 308*d* such that grinding of these elements may be performed simultaneously.

Figure 7:
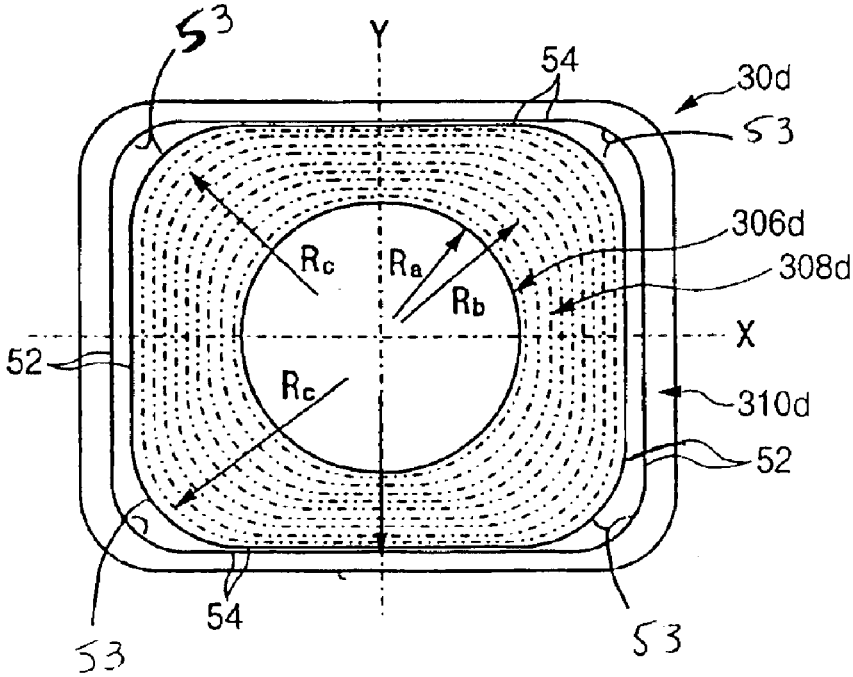
FIG. 7 is a front view of a ferrite core for a deflection yoke used in a cathode ray tube according to a first modified example of the first embodiment of the present invention.

FIG. 7 is a front view of a ferrite core for a deflection yoke used in a cathode ray tube according to a first modified example of the first embodiment of the present invention.

In the first modified example, only the third section 310*d* of the ferrite core 30*d* is different from the structure of the third section 310*d* of the first embodiment. In particular, the perimeter of the inner surface of the third section 310 has, at each of its four corners, the shape of a circle combined with two pairs of straight lines 52 and 54. The two pairs of straight lines 52 and 54 include one pair of vertical lines 52 that form left and right vertical edges, and one pair of horizontal lines 54 that form upper and lower horizontal edges. The vertical lines 52 correspond to the segments of a circle having the radius Rd that forms the vertical edges of the first embodiment of FIG. 3, and the horizontal lines 54 correspond to the circular cross section having the radius Re forming the horizontal edges of the first embodiment, of FIG. 3.

Each segments 53 of a circle of the modified example mentioned above connects one of four corners where the vertical and horizontal lines 52 and 54 meet. The segments of a circle here corresponds to the circle having the radius Rc of the first embodiment of FIG. 3.

Figure 8:
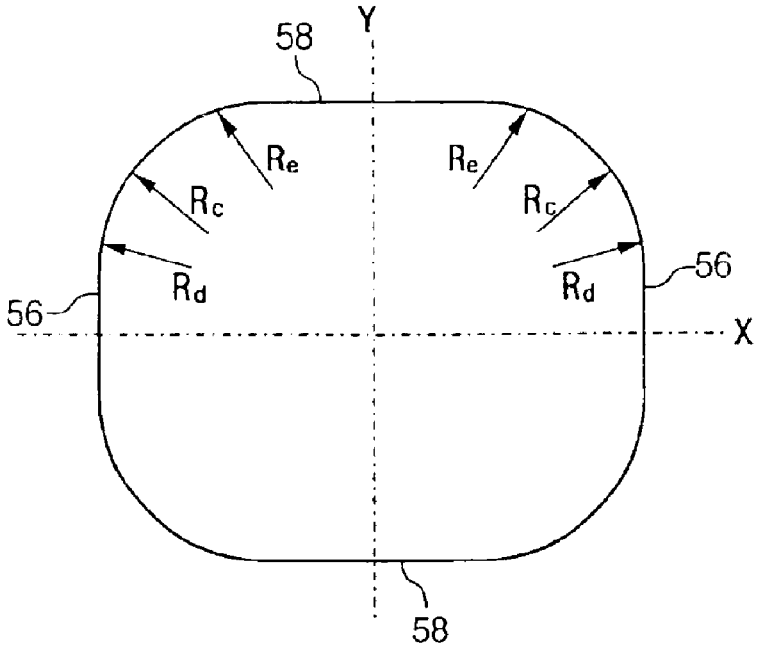
FIG. 8 is a sectional view used to describe a third section of a ferrite core for a deflection yoke used in a cathode ray tube according to a second modified example of the first embodiment of the present invention.

FIG. 8 is a sectional view used to describe a third section of a ferrite core for a deflection yoke used in a cathode ray tube according to a second modified example of the first embodiment of the present invention.

In the second modified example, only the third section 310 of the ferrite core 30*d* is different in structure than the ferrite core 30*d* described with reference to the first embodiment of the present invention. Specifically, the cross section of the third section 310*d* of the second modified example is formed by combining three circles and two pairs of straight lines 56 and 58. The two pairs of straight lines 56 and 58 include a pair of vertical lines 56 forming a center of left and right vertical edges, and a pair of horizontal lines 58 forming a center of upper and lower horizontal edges.

The three circles include a first circle having a radius Rc that forms corners in the vicinity of the four areas where the straight lines 56 and 58 would meet if extended, a second circle having a radius Re that connects the circle having the radius Rc and the pair of the horizontal lines 58, and a third circle having a radius Rd that connects the circle having the radius Rc and the pair of the vertical lines 56, as shown in FIG. 8.

With this structure of the second modified example of the first embodiment of the present invention, a smoother connection is made where the straight lines and circles meet.

Figure 9:
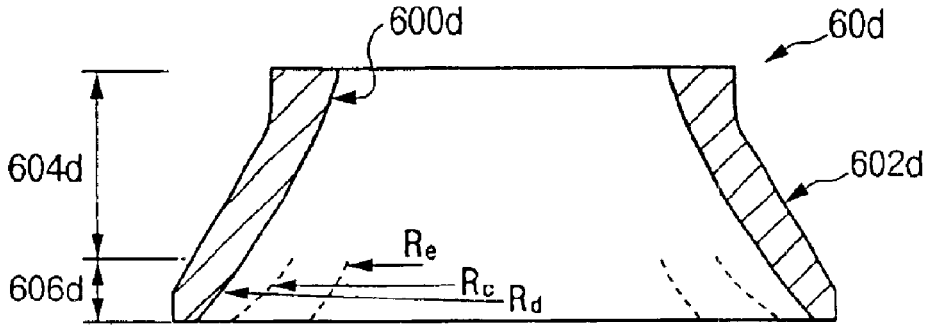
FIG. 9 is a sectional view of a ferrite core for a deflection yoke used in a cathode ray tube according to a second embodiment of the present invention.

FIG. 9 is a sectional view of a ferrite core for a deflection yoke used in a cathode ray tube according to a second embodiment of the present invention.

In the second embodiment of the present invention, a ferrite core 60*d* is funnel-shaped and has an inner surface 600*d* and an outer surface 602*d*, similar to the same element of the first embodiment. The inner surface 600*d* includes a first section 604*d* realized through a circle having a varying radius, and a second section 606*d* having a non-circular cross section and connected to the first section 604*d*.

The first section 604*d* of the inner surface 600*d* corresponds to the second section in the first embodiment, and the second section 606*d* corresponds to the third section in the first embodiment. Since the structures of these elements and of their modified example(s) are identical to that described above, a detailed description will not be provided herein.

The first section of the first embodiment that is a cylindrical member with having a circular cross sections with a radius that does not vary is not included in the ferrite core 60 of the second embodiment. This is because the deflection yoke is still able to increase its deflection angle even without including the first section in its ferrite core.

According to the deflection yoke for CRTs of the present invention described above, grinding may be performed over a significantly larger area of the inner surface of the ferrite core than in the prior art. As a result, greater precision in the dimensions of the inner surface of the ferrite core may be obtained, and a deflection yoke may be produced that allows for the realization of a CRT with improved precision and decreased dispersion.

Although some embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

For example, in the embodiments described above, the third section of the ferrite core is formed using three circles, or using one circle and two pairs of straight lines, or using three circles and two pairs of straight lines. However, the present invention is not limited to this configuration and more circles having differing radii and lines may be combined for a smoother connection.

What is claimed is:

1. A deflection yoke for a cathode ray tube including a ferrite core having a funnel-shaped body, an inner surface, and an outer surface, the inner surface of a cross section of the ferrite core comprising:

a first section having, along a length thereon, a shape of a circle with a predetermined, unvarying radius;

a second section having, along a length thereon, a shape of a circle with a varying radius, the second section being connected to the first section; and a third section having a non-circular shape and being connected to the second section, wherein the third section of the inner surface has a shape of interconnected segments of three circles, each of a different radius.

2. The deflection yoke of claim 1, wherein each said different radius of the third section increases from one end of the third section connected to the second section to an opposite end.

3. The deflection yoke of claim 1, further comprising a horizontal deflection coil, a vertical deflection coil, and an insulating member interposed between the horizontal and the vertical deflection coils.

4. The deflection yoke of claim 3, wherein the horizontal and the vertical deflection coils have a shape similar to a shape of the insulating member.

5. The deflection yoke of claim 3, wherein the horizontal and the vertical deflection coils include a pair of coil members.

6. A deflection yoke for a cathode ray tube including a ferrite core having a funnel-shaped body, an inner surface and an outer surface, the inner surface of a cross section of the ferrite core comprising:

a first section having, along a length thereon, a shape of a circle with a predetermined, unvarying radius;

a second section having, along a length thereon, a shape of a circle with a varying radius, the second section being connected to the first section, and a third section having a non-circular shape and being connected to the second section, wherein the third section of the inner surface has a shape of segment of a circle and two pairs of substantially straight lines including a pair of vertical lines and a pair of horizontal lines.

7. A deflection yoke for a cathode ray tube including a ferrite core having a funnel-shaped body, an inner surface, and an outer surface, the inner surface of a cross section of the ferrite core comprising:

a first section having, along a length thereon, a shape of a circle with a predetermined, unvarying radius;

a second section having, along a length thereon, a shape of a circle with a varying radius, the second section being connected to the first section, and a third section having a non-circular shape and being connected to the second section, wherein the third section has a shape of interconnected segments of three circles and two substantially straight lines.

8. A deflection yoke for a cathode ray tube including a ferrite core having a funnel-shaped body, an inner surface, and an outer surface, the inner surface of a cross section of the ferrite core comprising:

a first section having, along a length thereon, a shape of a circle with a predetermined, unvarying radius;

a second section having, along a length thereon, a shape of a circle with a varying radius, the second section being connected to the first section; and a third section having a non-circular shape and being connected to the second section, wherein the first and second sections have surfaces rougher than a surface of the third section.

9. A deflection yoke for a cathode ray tube including a ferrite core having a funnel-shaped body, an inner surface and an outer surface, the inner surface of a cross section of the ferrite core comprising:

a first section formed as having, along a length thereon, a shape of a circle with a varying radius; and a second section having a non-circular shape and being connected to the first section, wherein the second section of the inner surface has a shape of interconnected segments three circles, each of a different radius.

10. A deflection yoke for a cathode ray tube including a ferrite core having a funnel-shaped body, an inner surface and an outer surface, the inner surface of a cross section of the ferrite core comprising:

a first section formed as having, along a length thereon, a shape of a circle with a varying radius; and a second section having a non-circular shape and being connected to the first section, wherein the second section of the inner surface has a shape of a segment of a circle and two pairs of substantially straight lines including a pair of vertical lines and a pair of horizontal lines.

11. A deflection yoke for a cathode ray tube including a ferrite core having a funnel-shaped body, an inner surface and an outer surface, the inner surface of a cross section of the ferrite core comprising:

a first section formed as having, along a length thereon, a shape of a circle with a varying radius; and a second section having a non-circular shape and being connected to the first section, wherein the second section of the inner surface has a shape of interconnected segments of three circles and two subsantially straight lines.

12. A cathode ray comprising:

a substantially rectangular panel;

a funnel connected to the panel and having a cone shape;

a neck connected to the funnel;

a deflection yoke mounted to an outer circumference of the funnel; and a ferrite core mounted to a side of the deflection yoke, wherein the ferrite core includes a body having an inner surface and an outer surface, the inner surface of a cross section of the ferrite core comprising:

a first section having, along a length thereon, a shape of a circle with a predetermined, unvarying radius;

a second section having, along a length thereon, the shape of a circle with a varying radius, the second section being connected to the first section; and a third section having a non-circular shape and being connected to the second section, wherein the third section of the inner surface has a shape of interconnected segments of three circles, each of a different radius.

13. A cathode ray comprising:

a substantially rectangular panel;

a funnel connected to the panel and having a cone shape;

a neck connected to the funnel;

a deflection yoke mounted to an outer circumference of the funnel; and a ferrite core mounted to a side of the deflection yoke, wherein the ferrite core includes a body having an inner surface and an outer surface, the inner surface of a cross section of the ferrite core comprising:

a first section having, along a length thereon, a shape of a circle with a predetermined, unvarying radius;

a second section having, along a length thereon, the shape of a circle with a varying radius, the second section being connected to the first section; and a third section having a non-circular shape and being connected to the second section, wherein the third section of the inner surface has a shape of a segment of a circle and two pairs of substantially straight lines including a pair of vertical lines and a pair of horizontal lines.

* * * * *